US008191533B2

(12) United States Patent
Ulrey et al.

(10) Patent No.: US 8,191,533 B2
(45) Date of Patent: Jun. 5, 2012

(54) FUEL DELIVERY SYSTEM DIAGNOSTICS AFTER SHUT-DOWN

(75) Inventors: Joseph Norman Ulrey, Dearborn, MI (US); Ross Dykstra Pursifull, Dearborn, MI (US); Diana D. Brehob, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 167 days.

(21) Appl. No.: 12/833,714

(22) Filed: Jul. 9, 2010

(65) Prior Publication Data

US 2010/0275880 A1 Nov. 4, 2010

Related U.S. Application Data

(62) Division of application No. 12/107,285, filed on Apr. 22, 2008, now Pat. No. 7,762,234.

(51) Int. Cl.

| | |
|---|---|
| ***F02M 69/46*** | (2006.01) |
| ***F02M 17/30*** | (2006.01) |
| ***F02B 77/08*** | (2006.01) |
| ***F02D 17/00*** | (2006.01) |

(52) U.S. Cl. ..... 123/456; 123/198 D

(58) Field of Classification Search ..... 123/359, 123/447, 456, 457, 458, 463, 518–521, 198 D, 123/198 DB, 446; 73/40, 49.1, 49.2, 49.3, 73/49.7, 114.38, 114.41, 114.42, 114.43
See application file for complete search history.

(56) References Cited

U.S. PATENT DOCUMENTS

| | | | | |
|---|---|---|---|---|
| 4,269,061 | A | 5/1981 | Hatsuno et al. | |
| 5,715,786 | A | 2/1998 | Seiberth | |
| 5,795,995 | A * | 8/1998 | Shimaoka et al. | 73/40 |
| 5,974,865 | A * | 11/1999 | Dambach | 73/49.7 |
| 6,024,064 | A | 2/2000 | Kato et al. | |
| 6,138,638 | A * | 10/2000 | Morikawa | 123/295 |
| 6,467,466 | B1 * | 10/2002 | Maekawa et al. | 123/529 |
| 6,502,551 | B2 | 1/2003 | Antonioli et al. | |
| 7,117,729 | B2 | 10/2006 | Hosoya et al. | |
| 7,272,488 | B2 | 9/2007 | Hayashi et al. | |
| 7,337,652 | B2 | 3/2008 | Shamine | |
| 7,392,792 | B2 | 7/2008 | Puckett | |
| 2001/0032628 | A1 | 10/2001 | Goto et al. | |
| 2006/0048752 | A1 | 3/2006 | Stroia et al. | |
| 2007/0028897 | A1 | 2/2007 | Fukasawa | |

FOREIGN PATENT DOCUMENTS

| | | |
|---|---|---|
| GB | 2310458 A | 8/1997 |
| JP | 11183309 | 7/1999 |

* cited by examiner

*Primary Examiner* — Stephen K Cronin
*Assistant Examiner* — Sizo Vilakazi
(74) *Attorney, Agent, or Firm* — Julia Voutyras; Alleman Hall McCoy Russell & Tuttle LLP

(57) ABSTRACT

A method for operation of an engine fuel system includes initiating a mitigating action based on a fuel rail pressure response, the fuel rail pressure response occurring after an engine shut-down. The mitigating action includes disabling vehicle operation if fuel rail pressure drops below a threshold value after activation of one of the higher or lower pressure pumps, the activation occurring before a subsequent engine start. In this way, a distinction can be made between internal and external leaks, allowing the mitigating action taken to be adjusted accordingly.

20 Claims, 7 Drawing Sheets

FUEL DELIVERY SYSTEM DIAGNOSTICS AFTER SHUT-DOWN

CROSS REFERENCE TO RELATED APPLICATION

The present application is a divisional of U.S. patent application Ser. No. 12/107,285 filed on Apr. 22, 2008, the entire contents of which are incorporated herein by reference.

BACKGROUND/SUMMARY

Fuel delivery systems may include a number of pumps, such as a lower pressure pump and a higher pressure pump in order to deliver fuel at a high pressure to the cylinders, such as for gasoline direct injection. Highly pressurized fuel in the fuel delivery system may be particularly useful during crank and other times during engine operation for efficient combustion, etc.

Leaks in the fuel delivery system may substantially decrease the fuel pressure in the fuel delivery system, thereby leading to extended crank times due to incomplete or inefficient combustion, for example. Extended crank times in turn may increase emissions and/or cause cylinder misfires.

In one example, U.S. Pat. No. 5,715,786 attempts to detect leaks in the fuel delivery system by monitoring the pressure in the fuel delivery system in response to a predeterminable operating state, such as overrunning. After a predeterminable operating state has been detected, the device assesses whether or not the fuel injectors have malfunctioned (i.e. whether an injector is stuck open and leaking fuel). A malfunction of one or more of the fuel injectors may be determined by comparing predeterminable pressure values to measured pressure values. The device may then take actions to mitigate fuel leak effects on the system, such as shutting down the engine or turning off the high pressure pump.

The inventor herein has recognized several disadvantages with this approach. First, internal and external leaks may not be differentiated in U.S. Pat. No. 5,715,786. An internal leak may include a fuel leak that occurs through various components in the fuel delivery system. For example, at high pressure during engine shut-down fuel may leak back through a pump, where the aforementioned leak can be classified as an internal leak. However, external leaks may include fuel leaks that leak out of various components in the fuel delivery system, exposing pressurized fuel to atmospheric pressure. For example, a fuel line may degrade and a hole may develop in a portion of the fuel line, substantially decreasing the pressure in the fuel delivery system and in some cases rendering the fuel delivery system inoperable, where the aforementioned type of leak can be classified as an external leak. An external leak may also include a leak through the fuel injectors.

One approach includes a method for operation of a fuel delivery system in an internal combustion engine including a lower pressure pump, a higher pressure pump fluidly coupled downstream of the lower pressure pump, and a fuel rail fluidly coupled downstream of the high pressure pump including, initiating a mitigating action based on a fuel rail pressure response, the fuel rail pressure response occurring after an engine shut-down, where the mitigating action includes disabling vehicle operation if fuel rail pressure drops below a threshold value after activation of one of the pumps, the activation occurring before a subsequent engine start, the subsequent engine start occurring after the engine shut-down, and where the mitigating action includes adjusting operation of one of the pumps during the subsequent engine start if fuel rail pressure achieves at least the threshold value during the activation.

Another approach includes a method for operation of a fuel delivery system in an internal combustion engine having a fuel system including a lower pressure pump, a higher pressure pump fluidly coupled downstream of the lower pressure pump, a solenoid valve coupled between the higher and lower pressure pumps, and a fuel rail fluidly coupled downstream of the high pressure pump comprising: indicating a fuel system leak based on a fuel rail pressure response, the fuel rail pressure response occurring after an engine shut-down; in response to the indication and before a subsequent engine start, the subsequent engine start occurring after the engine shut-down, adjusting the solenoid valve; differentiating whether the leak includes an internal or external leak based on fuel pressure response occurring after the solenoid valve is adjusted In these ways, a distinction can be made between internal and external leaks, for example, allowing the mitigating action taken to be adjusted accordingly. In particular, the presence of either type of leak may be accurately obtained after an engine shutdown to reduce interference from engine operation. Then, different types of leaks may be accurately distinguished before a subsequent engine start due to the particular configuration of the system by monitoring the fuel rail pressure. Similarly, different types of leaks may be accurately distinguished by appropriate control of a valve in the fuel system that assists in isolating the leak source.

DETAILED DESCRIPTION

Figure 1:
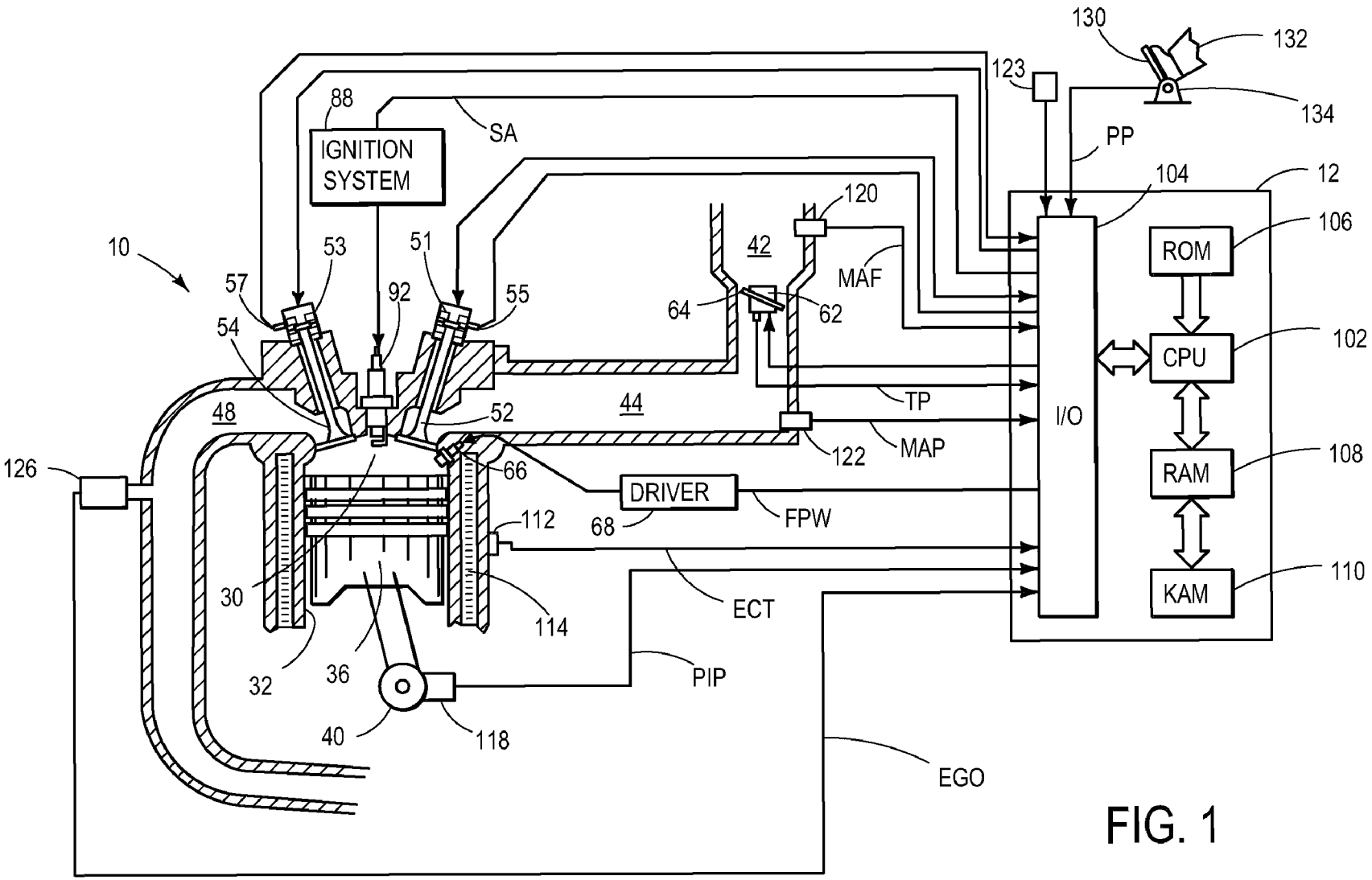
FIG. 1 shows a schematic depiction of one cylinder in the internal combustion engine.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft.

Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system, shown in FIG. 2. In some embodiments, combustion chamber 30 may alternatively or additionally include a fuel injector arranged in intake passage 44 in a configuration that provides what is known as port injection of fuel into the intake port upstream of combustion chamber 30. Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; a key position from ignition sensor 123; and absolute manifold pressure signal, MAP, from sensor 122. Engine speed signal, RPM, may be generated by controller 12 from signal PIP. The operator of the automobile may initiate a shut-down request by deactivating an ignition apparatus (not shown). Deactivating an ignition apparatus may include rotating a key in an ignition and/or depressing an ignition button. Furthermore, controller 12 may initiate a shut-down request based on various operating conditions in the engine such as oil pressure, engine speed, engine temperature, etc. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

As described above, FIG. 1 shows only one cylinder of a multi-cylinder engine, and that each cylinder may similarly include its own set of intake/exhaust valves, fuel injector, spark plug, etc.

Figure 2:
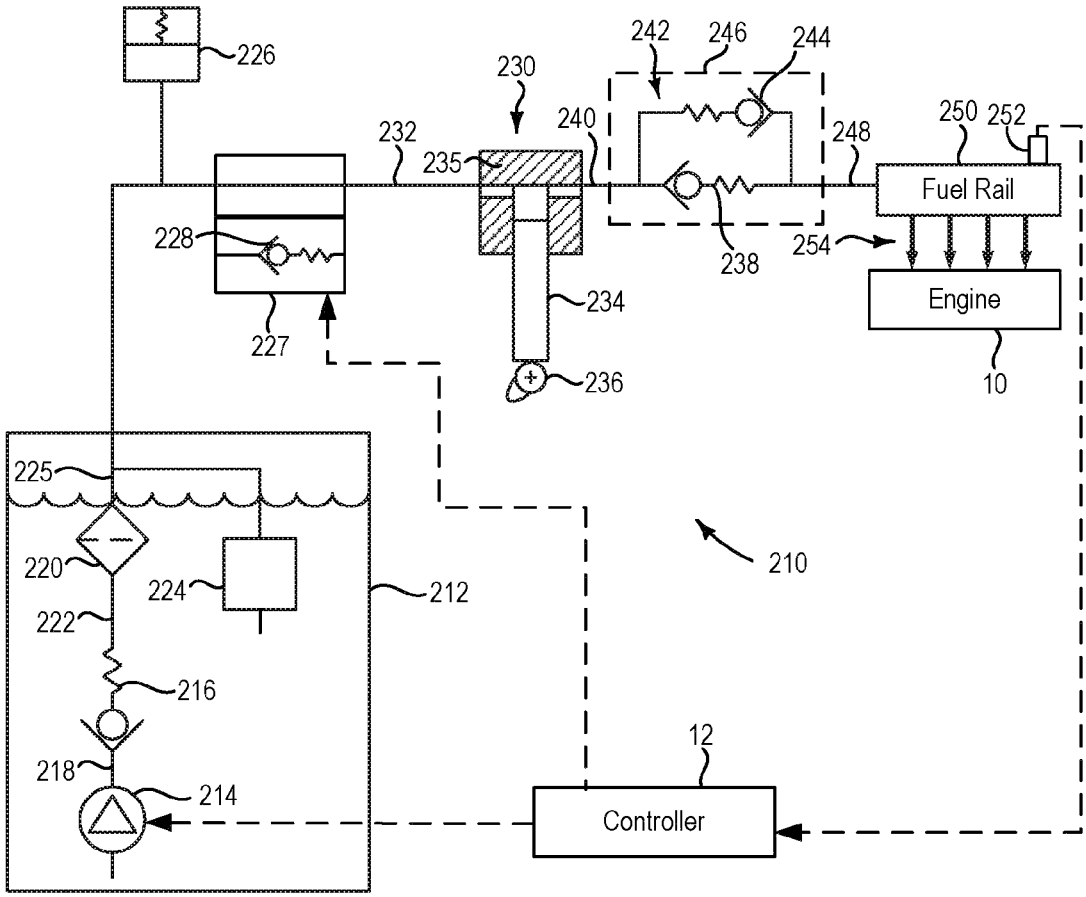
FIG. 2 shows a schematic depiction of the fuel delivery system for the internal combustion engine.

FIG. 2 shows a diagram of a fuel delivery system 210 that may be used to deliver fuel to the internal combustion engine 10, shown in FIG. 1. The fuel delivery system may include a fuel tank 212 substantially surrounding a lower pressure fuel pump 214. In one example, the lower pressure fuel pump 214 may be an electronically actuated lift pump. In another example, lower pressure fuel pump 214 may be another suitable pump capable of delivering fuel at an increased pressure to downstream components, such as a rotodynamic pump. The lower pressure fuel pump 214 may be actuated by a command signal sent from controller 12. In some examples, a control module (not shown) may control the actuation of pump 214.

Figure 7:
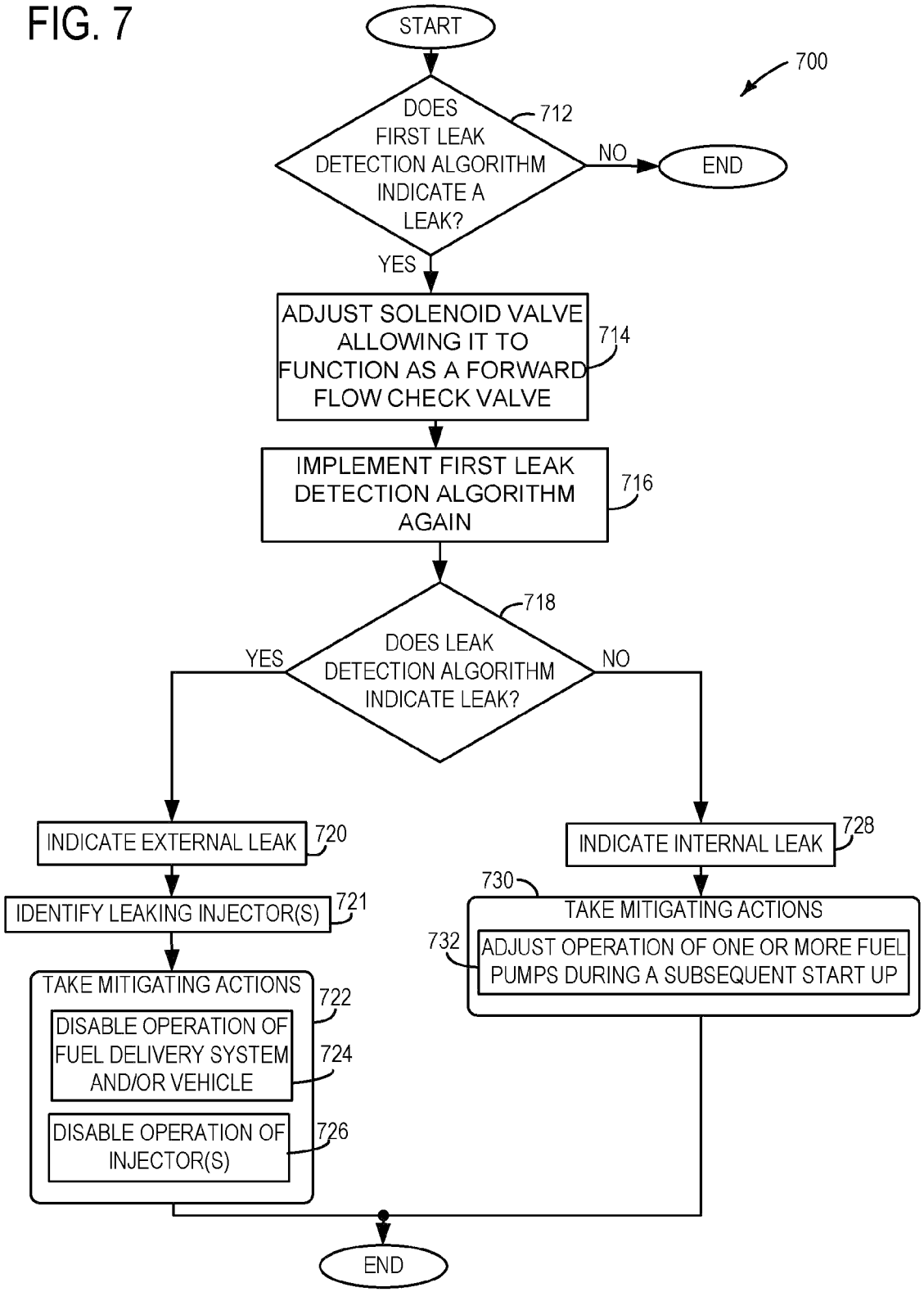
FIG. 7 shows another example of a detailed flow chart, part of which may be implemented as a second leak detection algorithm.
Figure 8:
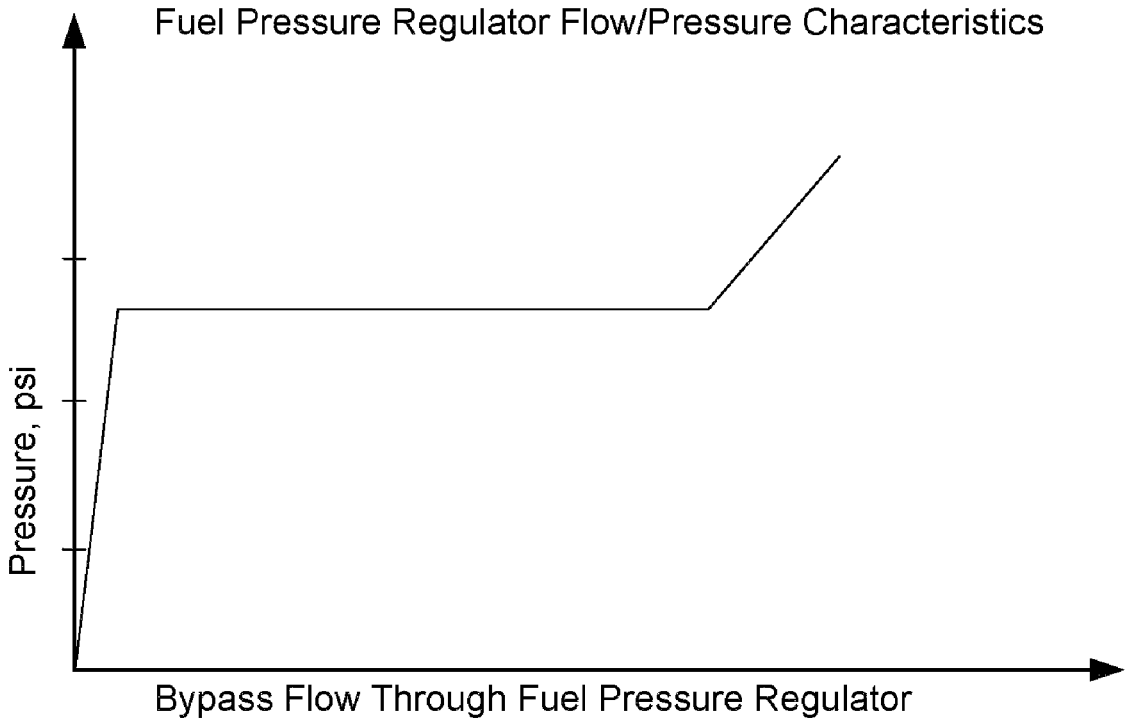
FIG. 8 illustrates example characteristics of a fuel pressure regulator shown in FIG. 2.

Furthermore, the lower pressure pump may increase the downstream pressure in the fuel delivery system. The lower pressure pump may be fluidly coupled to a check valve 216, represented by the standard ball and spring symbol, by fuel line 218. Check valve 216 allows fuel to travel downstream, under some conditions, and impedes fuel from traveling upstream when there is a sufficient pressure differential. In another example, other suitable valves may be used that can impede fluid from traveling upstream into the fuel tank. Check valve 216 may be fluidly coupled to a fuel filter 220 by a fuel line 222. The fuel filter may remove unwanted particles from the fuel in the fuel line. A fuel pressure regulator 224 may be coupled to fuel line 225. The fuel pressure regulator may regulate the pressure of downstream components while impeding the amount of fuel that may be re-circulated back into the fuel tank. The characteristics of an exemplary fuel pressure regulator are shown in FIG. 7. In other examples, the fuel pressure regulator may have other characteristics.

Again referring to FIG. 2, the fuel line 225 may extend out of the fuel tank fluidly coupling the fuel filter and a fuel pressure accumulator 226. In some examples, the fuel pressure accumulator may be a Freundenberg fuel pressure accumulator. In other examples, the fuel pressure accumulator may be another suitable fuel accumulator that allows a greater amount of fuel to be stored in the fuel delivery system, downstream of the lower pressure pump. Yet in other examples, the fuel pressure accumulator may be removed. A solenoid valve 227 may be fluidly coupled downstream of the fuel pressure accumulator. Solenoid valve 227 may include a check valve 228. Controller 12 may be electronically coupled to solenoid valve 227. In this example, when solenoid valve 227 is unpowered, fluid is allowed to flow freely through the valve. However, when solenoid valve 227 is powered by the controller, check valve 228 is configured to impede fluid from traveling upstream of check valve 228, under some conditions. In other examples, check valve 228 may be configured to impede fluid from traveling upstream of the valve when solenoid valve 227 is powered. The solenoid valve may be controlled synchronous to the higher pressure pump's cam position, to achieve an effective displacement of 0 to 0.25 cc per stroke.

A higher pressure pump 230 may be coupled downstream of the fuel pressure accumulator 226 by a fuel line 232. In this example, the higher pressure fuel pump is mechanically actuated positive displacement pump that includes a piston 234, a cylinder 235, and a cam 236. The higher pressure pump may use mechanical energy, produced by the engine, for actuation. In other examples, the higher pressure pump may be another suitable pump such as an electronically actuated pump.

A check valve 238 may be coupled downstream of the higher pressure pump by fuel line 240. Bypass fuel line 242 may be coupled directly upstream and downstream of check valve 238. The bypass fuel line may contain a pressure relief valve 244. In this example, pressure relief valve 244 is a check valve, represented by the industry standard ball and spring. In other examples, pressure relief valve may be another suitable valve which prevents the pressure downstream of valve 244 from becoming too high and possibly damaging downstream components as well as impedes fuel from traveling upstream under some conditions. In some examples, check valve 238 and bypass fuel line 242 may be referred to as a parallel port pressure relief valve PPRV 246.

A fuel rail 250 may be coupled to the parallel port pressure relief valve 246 by fuel line 248. A pressure sensor 252 may be coupled to the fuel rail. The pressure sensor may be electronically coupled to controller 12. Furthermore, the pressure sensor may measure the pressure of the fuel in the fuel rail. In other examples, the pressure sensor may be coupled to another location in the fuel delivery system downstream of the higher pressure pump. In some examples, a temperature sensor (not shown) may be coupled to the fuel rail. The temperature sensor may measure the temperature of the fuel rail. The fuel rail may be fluidly coupled to a series of fuel injectors 254. The fuel injectors may delivery fuel to the engine 10. Several diagnostic algorithms that may be implemented on the fuel delivery system, shown in FIG. 2, are discussed in more detail herein.

Figure 3:
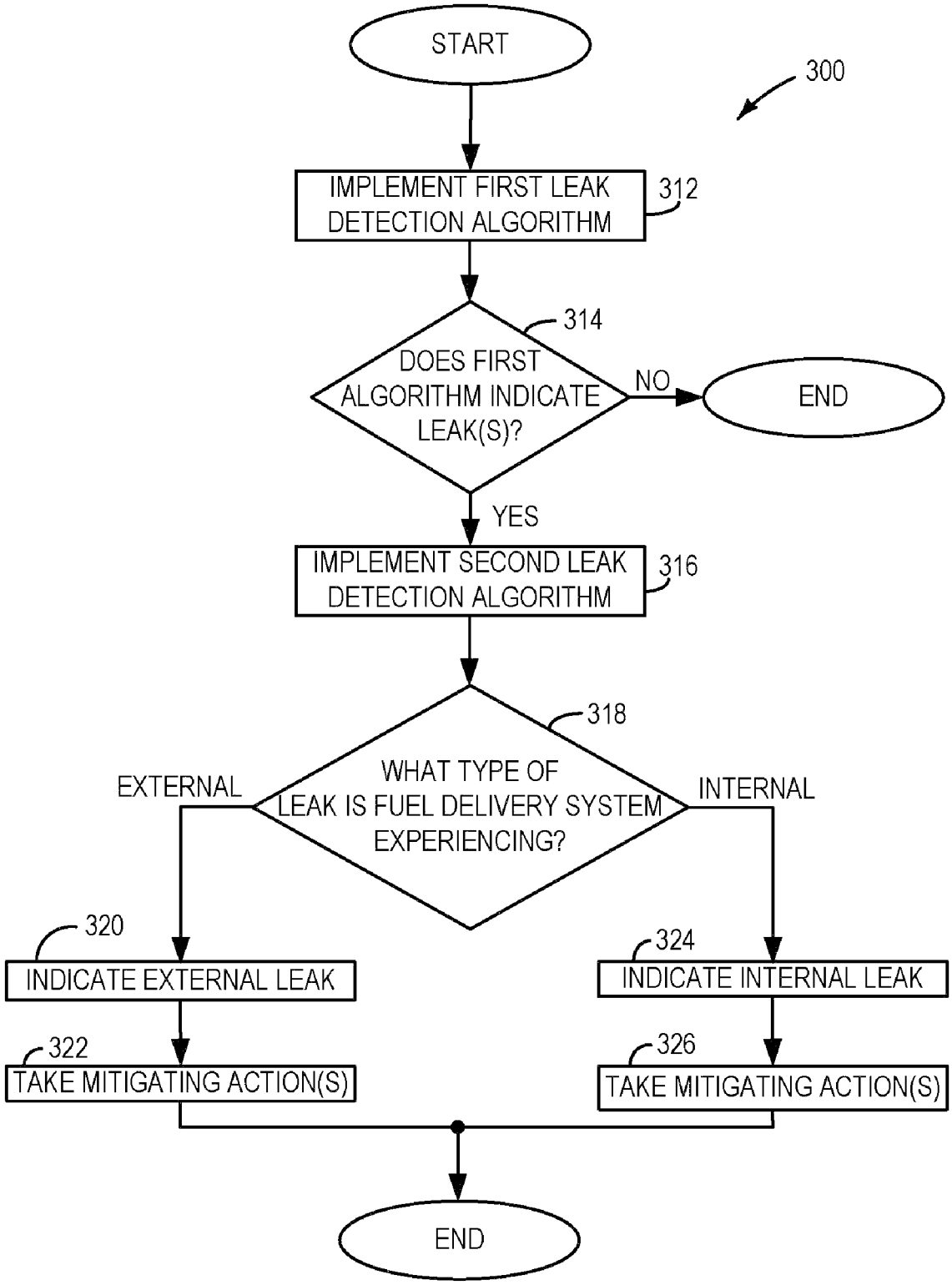
FIG. 3 shows a high level diagnostic flow chart that may be implemented to detect leaks in the fuel delivery system and take mitigating action(s).
Figure 4:
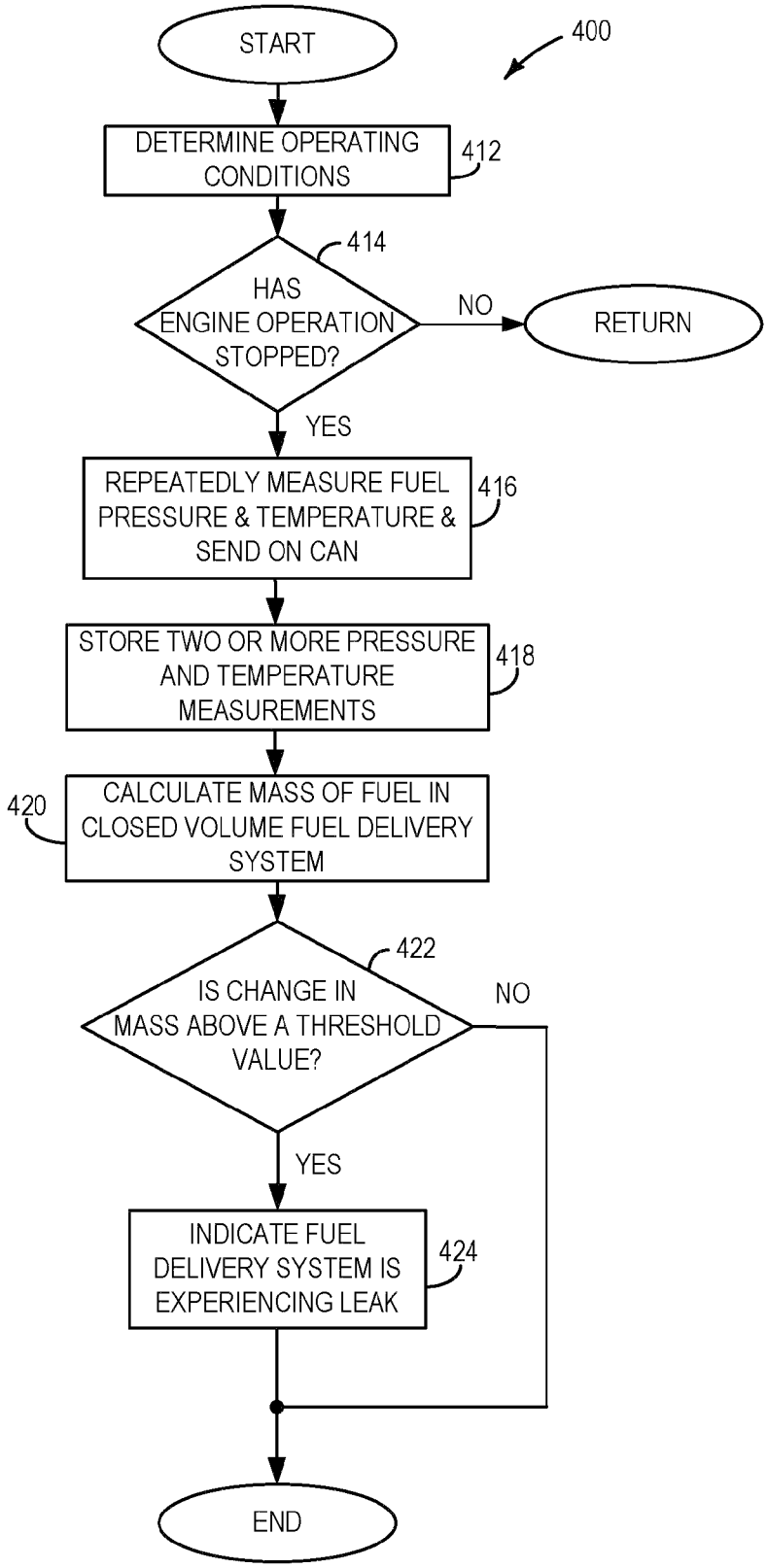
FIG. 4 shows an example of a detailed flow chart that may be implemented as a first leak detection algorithm.
Figure 5:
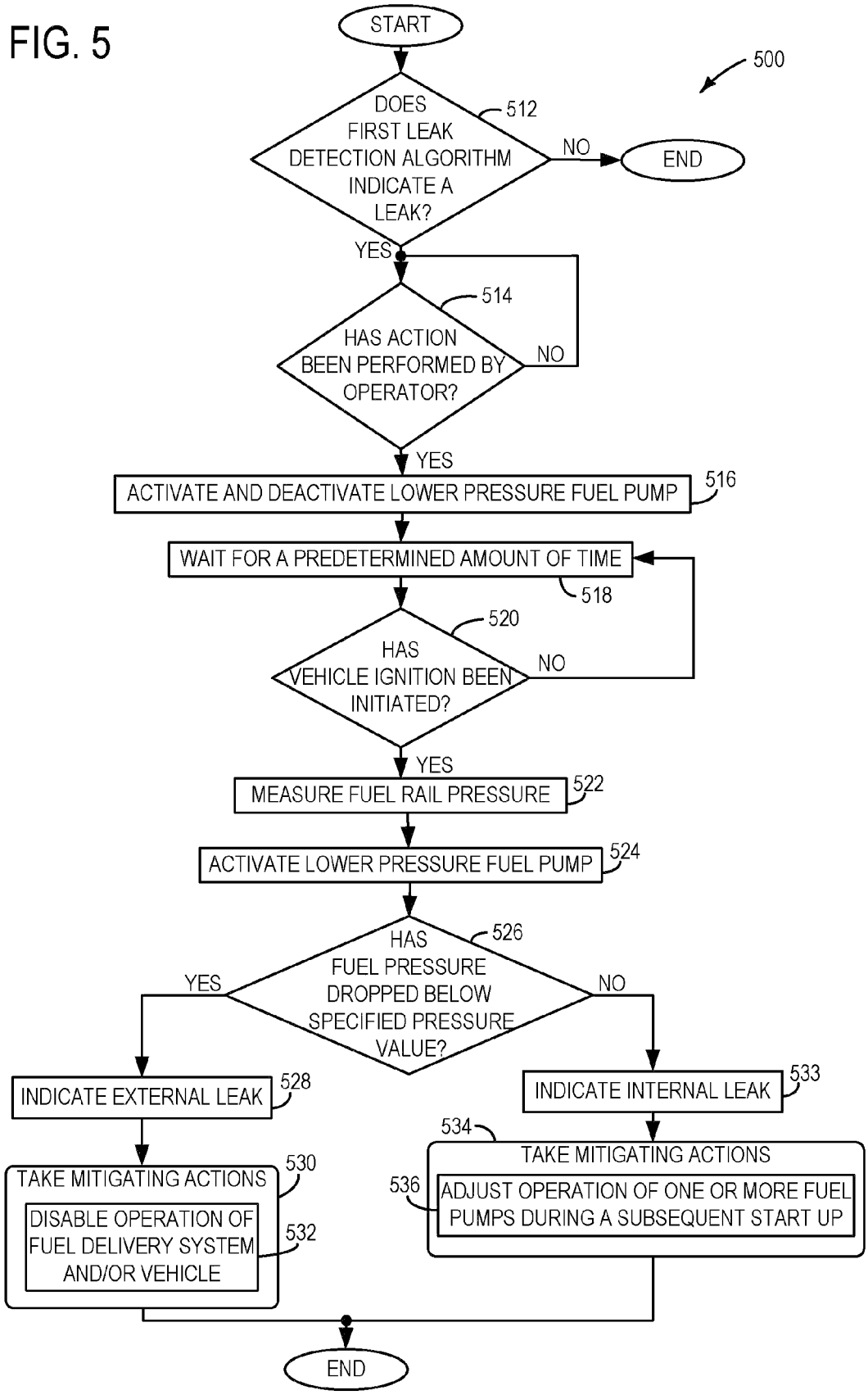
FIG. 5 shows an example of a detailed flow chart part of which may be implemented as a second leak detection algorithm.

FIG. 3-FIG. 5 illustrate methods that may be implemented to perform diagnostics on a fuel delivery system during an engine shut-down, after an engine shut-down request. In one example, the engine shut-down may include the time interval after a shut-down request and before a subsequent engine start. In particular, FIG. 3 shows a high level diagnostic flow chart or method. FIG. 4 and FIG. 5 show detailed examples of methods or algorithms that may be implemented as part of the diagnostic algorithm shown in FIG. 3.

The diagnostic methods, shown in FIG. 3-FIG. 5, may be implemented as executable code set by controller 12. Furthermore, a code reader may be electronically interfaced with controller 12 to read various diagnostics indicated by controller 12. In some examples, the code reader is a universal code reader. In other examples, the code reader may be another suitable device.

FIG. 3 illustrates a high level diagnostic flow chart, routine 300, that may be implemented to perform diagnostics on the fuel delivery system. The majority of the diagnostic routine may be carried out during a time interval during engine shut-down. In particular, a first leak detection algorithm and a second leak detection algorithm may be carried out during engine shut-down, and before a subsequent start when fuel in the cylinder is combusted. The algorithms may include taking mitigating action, discussed in more detail herein, before or during cranking, which may increase the efficiency of the combustion, decrease emission, as well as decrease the crank time. Furthermore, the fuel delivery system diagnostic routine 300 may improve the accuracy of the fuel delivery system through responsive mitigating actions after crank during normal operation of the engine, thereby increasing the efficiency of the engine and decreasing emissions.

In some examples, the fuel delivery system diagnostic routine 300 may reduce damage to engine components by inhibiting operation of the engine when the fuel delivery system is experiencing sufficiently large external leaks. Additionally, the routine may take various mitigating actions in response to an internal leak.

An internal leak may include leaks upstream through various components in the fuel delivery system. For example, the fuel may leak back through the higher pressure pump after engine shut down, due to an increase in temperature of the fuel delivery system. However, external leaks may include fuel leaks that leak out of various components in the fuel delivery system, exposing pressurized fuel to atmospheric pressure, such as through the injectors.

At 312, the first leak detection algorithm is implemented, to determine if the fuel delivery system is experiencing one or more leaks. In some examples, the first leak detection algorithm may be method 400, discussed in greater detail herein. In other examples, other suitable leak detection algorithms may be used to determine if the fuel delivery system is experiencing one or more leaks during a key-off condition. If the first leak detection algorithm detects a leak, a diagnostic code may be set in controller 12 that is readable by a code reader.

The routine then advances to 314, where it is determined if the first leak detection algorithm indicates one or more leaks in the fuel delivery system.

If it is determined that no leak indication has been made, the routine ends. However, if it is indicated by the first leak detection algorithm that the fuel delivery system is experiencing one or more leaks, the routine advances to 316 where a second leak detection algorithm is implemented. In some examples, the second leak detection algorithm may include the leak detection algorithm illustrated in FIG. 5. In other examples, another suitable leak detection algorithm that can be implemented during a key-off condition to detect a leak in the fuel delivery system may be used.

The routine then proceeds to 318, where the type of leak that the fuel delivery system experiencing is determined. If it is determined that the fuel delivery system is experiencing an external leak, the routine advances to 320, where an indication is made that an external leak is present. An external leak may include fuel leaking out of various components in the fuel delivery system, exposing pressurized fuel to atmospheric pressure. For example, a fuel line may degrade and a hole may develop in a portion of the fuel line, substantially decreasing the pressure in the fuel delivery system and in some cases rendering the fuel delivery system inoperable.

The external leak indication may include sending an external indication on a Computer Area Network (CAN) and storing the indication in RAM. Furthermore, when an indication is made that an external leak is present, a code may be set in controller 12 that is readable by a code reader, the code indicating an external leak. The routine then advances to 322 where mitigating action(s) are taken. The mitigating actions include: disabling operation of the engine and/or vehicle, adjusting the operation of one or more pump, and various others. Adjusting operation of one or more pumps includes disabling operation of one or more pumps. After 322 the routine ends.

However, if the fuel delivery system is experiencing an internal leak, the routine advances to 324, where an indication is made that an internal leak is present. The internal leak indication may include sending an internal leak indication on the CAN and storing the indication in RAM. Furthermore, when an indication is made that an internal leak is present, a code indicating an internal leak may be set in controller 12 that is readable by a code reader. Then, the routine advances to 326, where mitigating action(s) are taken. The mitigating actions include: adjusting operation of one or more pumps, adjusting injection profile and/or timing, disabling on or more of the pumps, as well as various others. Then, after 326 the routine ends.

FIG. 4 shows an example of first leak detection algorithm 400 that may be implemented at 312, shown in FIG. 3. Algorithm 400 may be implemented to detect or indicate if the fuel delivery system is experiencing a general leak (internal or external). The specific type of leak may be detected or indicated by a second leak detection algorithm, such as described with regard to FIG. 5, for example.

Again referring to FIG. 4, at 412 the algorithm determines the operating conditions of the fuel delivery system. The operating conditions may include: crank angle, pedal position, vehicle acceleration, key position, door position, etc.

Next, the algorithm proceeds to 414, where it is determined if operation of the engine has stopped. The determination may be based on various operating conditions, such as: key position, door position, valve position, engine speed, and various others. If operation of the engine has not stopped, the routine returns to the start. In other examples, the algorithm may end if operation of the engine has not stopped.

However, if the operation of the engine has stopped, the algorithm proceeds to 416, where the fuel pressure downstream of the higher pressure pump is repeatedly measured, along with the temperature of the engine and/or fuel delivery.

The algorithm then proceeds to 418, where two or more substantially concurrent pressure and temperature measurements are stored. The pressure measurements may be taken downstream of the higher pressure pump. The temperature measurements include temperature of the engine and/or fuel delivery system. In some examples, the pressure and temperature measurements are taken at predetermined times. In other examples, the pressure and temperature measurements are taken once predetermined pressures and/or temperatures are reached (e.g., the pressure measurement is taken once a specified temperature is reached). An example of such measurements is described with regard to FIG. 6.

Figure 6:
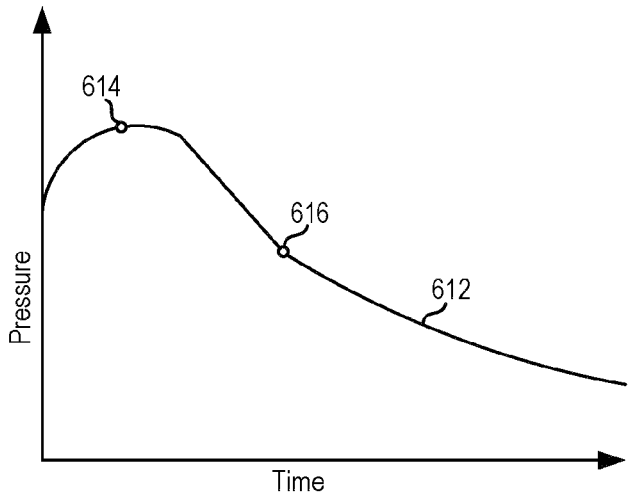
FIG. 6 illustrate graphically how the pressure may be measured during engine shut-down, after a shut-down request, while fuel delivery system diagnostics may be performed.

FIG. 6 illustrates a graph of a pressure profile 612 that may occur in the fuel delivery system after engine shut-down and/or after a key-off condition, but before a subsequent start of the engine. Pressure is on the y-axis and time is on the x-axis. In this example, two pressure measurements are taken and stored at points 614 and 616, along with substantially concurrent temperature measurements. In this way two or more substantially concurrent temperature and pressure measurements may be taken during engine shut-down in a closed volume state, where the closed volume state occurs when the operation of the pumps and injectors has been shut down. While the pressure profile or response includes two pressure measurements in this example, various other indications of the pressure variation over time can be used. Likewise, a temperature profile or response may include two or more temperature measurements, or other indications of variation over time. The pressure measurements shown in FIG. 6 give an example of the pressure measurements that may be stored at 418.

Again referring to FIG. 4, the algorithm proceeds to 420 where the change in mass of the fuel in the fuel system downstream of the higher pressure pump is calculated. Additionally or alternatively, the timed rate of change of the mass of the fuel in the fuel delivery system downstream of the higher pressure pump may be calculated. The change in mass of the fuel in the fuel delivery system may be carried out by entering some of the pressure and temperature values, stored at 418, into equation 1 given below. A table defining the parameters in the equation is shown below.

| | |
|---|---|
| $P_1$ | Initial pressure |
| $P_2$ | Final pressure |
| $T_1$ | Initial temperature |
| $T_2$ | Final temperature |
| K | Bulk modulus |
| C | Coefficient of thermal expansion |
| V | Volume of fuel rail |
| ρ | Density Of Fuel At $P_1$ and $T_1$ |

$$\text{Mass Loss}=V*\rho[(P_2-P_1)*K+(T_2-T_1)*C] \quad (1)$$

In other examples, another approach for calculating the change in mass of the fuel in the fuel delivery system, downstream of the high pressure pump, may be used.

The algorithm then proceeds to 422, where it is determined if the change in the mass of the fuel, in the fuel delivery system, is above a threshold value. For example, the routine determines if the fuel delivery system is experiencing a leak (s). The threshold value may take into account various parameters such as temperature and pressure of the fuel delivery system, precision of the pressure and temperature sensors, uncertainty in the mass loss calculation, compliance of the fuel delivery system, as well as various others. The threshold value may be a predetermined value or may be calculated during each execution of the algorithm 400. Alternatively, it may be determined if the mass flowrate, volume loss, and/or volumetric flowrate is above a threshold value.

If the change in mass of the fuel is not above a threshold value, the algorithm ends. However, if the change in mass of the fuel is above a threshold value, an indication is made that the fuel delivery system is experiencing a leak(s) at 424. After 424 the algorithm ends.

FIG. 5 shows a method 500 that includes an example of the second leak detection algorithm. Specifically, the second leak detection algorithm may include blocks 514-524. Blocks 514-524 may be implemented at 316, shown in FIG. 3. Furthermore, method 500 may be implemented to determine the specific type of leak (internal or external) that the fuel delivery system may be experiencing. In some examples, method 500 may be implemented by controller 12. In other examples, method 500 may be implemented by another suitable controller.

At 512 it is determined if the first leak detection algorithm indicates a leak. If the first leak detection algorithm indicates that the fuel delivery system is not experiencing a leak, the method ends. In other examples, method 500 may return to the start of routine 300.

However, if the first leak detection algorithm indicates that the fuel delivery system is experiencing a leak, the method advances to 514, where it is determined if an action has been performed by a vehicle operator that may indicate ignition of the vehicle is likely to occur shortly after the action is performed. The aforementioned actions include: opening the door, rotating the steering wheel, unlocking the door(s), and various others. In an additional example, the initiation of ignition may be delayed for a specified amount of time, allowing the second leak detection algorithm to be implemented before ignition of the engine. If an action is not performed that may indicate that ignition of the vehicle is likely to occur shortly after the action is performed, the method returns to 514. In some examples, the method may wait for a predetermined time before returning to 514.

However, if an action is performed that may indicate that ignition of the vehicle is likely to occur shortly after the action is performed, the method advances to 516 where the lower pressure pump is activated and then subsequently deactivated. In this way, the lower pressure pump may be adjusted based on two or more substantially concurrent pressure and temperature measurements. In one example, the lower pressure pump may be activated for one to two seconds, and then deactivated. In other examples, the time that the lift pump is activated may be adjusted based on operating conditions. Yet in other examples, another pump may be activated and then deactivated. Additionally, the pressure downstream of the higher pressure pump may be measured between 514 and step 516, such as two or more pressure measurements of the fuel rail.

Next the method advances to 518 where the method waits for a predetermined period of time. Then, the method advances to 520, where it is determined if vehicle ignition has been initiated. Initiation of vehicle ignition may include rotation of an ignition key, actuation of a push button ignition, etc. If the vehicle ignition has not been initiated, the method returns to 518. However, if it is determined that the vehicle ignition has been initiated, the method will advance to 522 where the fuel rail pressure is measured one or more times before the lower pressure fuel pump is operated. In other examples, the fuel rail pressure may be measured during operation of the lower pressure pump. In some examples, the ignition of the vehicle may be delayed. Yet, in other examples, the pressure may be measured at another location downstream of the higher pressure pump.

The method then advances to 524 where the lower pressure fuel pump is activated. The lower pressure fuel pump may be activated by controller 12. The method then advances to 526, where it is determined if the fuel rail pressure or the fuel pressure downstream of the higher pressure fuel pump at 522 while the lower pressure pump was not being operated dropped below a specified pressure value. In some examples, the specified pressure value may be the pressure regulated by the PPRV 246 during a key-off condition, before the second leak detection algorithm is implemented. In other examples, the specified pressure value may be another suitable pressure, such as a pressure measurement taken between 514 and 516.

If it is determined that the fuel pressure dropped below a specified pressure value or does not achieve a specified pressure threshold value, the method advances to 528, where it is indicated that there is an external leak in the fuel delivery system. Then, the method advances to 530, where actions are taken to mitigate the external leak. The mitigating actions may include: disabling the fuel delivery system, engine, and/or the vehicle 532, adjusting operation of one or more pumps (not shown), and various others. After 532 the method ends.

However, if the pressure in the fuel rail or the pressure downstream of the higher pressure pump has not dropped below a specified pressure value or has achieved a threshold pressure value, the method advances to 533 where it is indicated that an internal leak in the fuel delivery system is present.

The method then advances to 534 where actions are taken to mitigate the internal leak. The mitigating actions may include: adjusting operation of one or more fuel pumps during a subsequent start 536, adjusting injection profile (not shown), adjust injection timing (not shown), and various others. Adjusting operation of one or more pumps may include disabling one or more pumps. After 536 the method ends.

In this way, based on the fuel rail pressure response during an engine start, it may be possible to differentiate a type of leak in the fuel system, and take appropriate action.

FIG. 7 shows another method 700 that may form a portion of the second leak detection algorithm. In this example, method 700 determines the specific location of a leak in the fuel delivery system, and differentiates whether the leak is an internal, or external, leak. For example, method 700 determines if the leak is occurring through the higher pressure pump, or through one or more of the injectors. In this example, method 700 is implemented by controller 12. In other examples, method 700 may be implemented by another suitable controller.

At 712 it is determined if the first leak detection algorithm indicates a leak in the fuel delivery system. If the first leak detection algorithm indicates that the fuel delivery system is not experiencing a leak, the method ends. However, if the first leak detection algorithm indicates a leak in the fuel delivery, the method advances to 714, where solenoid valve 227 shown in FIG. 2, is adjusted allowing the solenoid valve to function as a forward flow check valve. In this example the solenoid valve is powered. In other examples, another suitable valve may be used that allows fluid to flow freely through the valve in one mode, and function as a forward flow check valve in another mode.

The method then proceeds to 716, where the first leak detection algorithm is implemented for a second time. Next, the method advances to 718, where it is determined if the first leak detection algorithm still indicates a leak. If the first leak detection algorithm still indicates that there is a leak, an external leak in the fuel system is indicated at 720. In some examples, the method may identify that fuel is leaking through one or more injectors.

Next the method proceeds to 721 where the specific injector(s) from which the leak is occurring may be identified. The leaking injector(s) may be identified based on a misfire of a corresponding cylinder during an engine start. The method then advances to 722 where mitigating actions are taken. The mitigating actions include: disabling operation of the fuel delivery system and/or the vehicle (724), and/or the specified injectors (726), etc.

However, if the first leak detection algorithm does not indicate a leak during the second implementation, an internal leak may be indicated at 728. In some examples, it may be indicated that a leak is occurring through the higher pressure pump. Next, the method advances to 730 where mitigating actions are taken. The mitigating actions may include: adjusting operation of one or more fuel pumps during a subsequent start (732), adjusting injection profile (not shown), adjust injection timing (not shown), and various others. After 730 the method ends.

In this way, it may be possible to differentiate leaks by appropriate utilization of a valve coupled upstream and/or downstream of the high pressure pump.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operation of a fuel delivery system in an internal combustion engine including a lower pressure pump, a higher pressure pump fluidly coupled downstream of the lower pressure pump, and a fuel rail fluidly coupled downstream of the high pressure pump comprising:

initiating a mitigating action based on a fuel rail pressure and temperature response profile, the fuel rail pressure response occurring after an engine shut-down, where the mitigating action includes disabling vehicle operation if fuel rail pressure drops below a threshold value after activation of one of the pumps, the activation occurring before a subsequent engine start, the subsequent engine start occurring after the engine shut-down, and where the mitigating action includes adjusting operation of one of the pumps during the subsequent engine start if fuel rail pressure achieves at least the threshold value after or during the activation.

2. The method of claim 1 wherein activation of one or more of the pumps includes activating and deactivating the lower pressure pump.

3. The method of claim 2 wherein the lower pressure pump is activated between 1 and 2 seconds.

4. The method of claim 1 wherein mitigating action is initiated based on a fuel rail pressure and temperature response profile.

5. The method of claim 4 wherein the pressure profile includes two or more measurements of the fuel in the fuel rail, and where the temperature profile includes two or more measurements of engine temperature.

6. The method of claim 5 wherein respective pairs of the temperature and pressure measurements are substantially concurrent.

7. The method of claim 1 wherein the lower pressure pump is a lift pump.

8. The method of claim 1 further comprising indicating an external leak when the fuel rail pressure drops below a threshold pressure and indicating an internal leak when the fuel rail pressure achieves at least the threshold value after or during the activation.

9. The method of claim 1 wherein the mitigating action includes adjusting an injection profile during the subsequent start based on the pressure response.

10. The method of claim 1 wherein the mitigating action includes setting a diagnostic code.

11. The method of claim 1 wherein the mitigating action includes delaying activation of a pump during the subsequent start.

12. The method of claim 1 wherein the mitigating action includes disabling both pumps during the subsequent start.

13. A method for operation of a fuel delivery system in an internal combustion engine having a fuel system including a lower pressure pump, a higher pressure pump fluidly coupled downstream of the lower pressure pump, and a fuel rail fluidly coupled downstream of the high pressure pump comprising:

indicating a fuel system leak based on a fuel rail pressure response and a temperature response, the fuel rail pressure and temperature response occurring after an engine shut-down; and in response to the indication and before a subsequent engine start, the subsequent engine start occurring after the engine shut-down, activating and then deactivating the lower pressure pump;

disabling vehicle operation if fuel rail pressure drops below a threshold value during or after the activation of the lower pressure pump; and adjusting operation of one of the pumps during the subsequent engine start if fuel rail pressure achieves at least the threshold value during or after the activation of the lower pressure pump.

14. The method of claim 13 where the fuel rail pressure and temperature response includes two or more substantially concurrent temperature and pressure measurements while the fuel system is in a closed volume state.

15. The method of claim 14 wherein the pressure measurements include a difference between a measured pressure, taken after the activation and deactivation of the lower pressure pump, and a previous pressure measurement.

16. The method of claim 15 wherein the previous pressure measurement includes a regulated pressure during a key-off condition.

17. The method of claim 13 further comprising indicating an external leak if fuel rail pressure drops below a threshold value during or after the activation of the lower pressure pump.

18. The method of claim 17 further comprising indicating an internal leak if fuel rail pressure achieves at least the threshold value during or after the activation of the lower pressure pump.

19. An article of manufacture for controlling operation of a fuel delivery system in an internal combustion engine having a fuel system including a lower pressure pump, a higher pressure pump fluidly coupled downstream of the lower pressure pump, and a fuel rail fluidly coupled downstream of the high pressure pump, the article comprising:

code for indicating a fuel system leak based on a plurality of concurrent fuel rail pressure and temperature measurements, at least some of the fuel rail pressure and temperature measurements taken after an engine shut-down; and code for, in response to the indication and before a subsequent engine start, the subsequent engine start occurring after the engine shut-down, activating and then deactivating the lower pressure pump;

code for disabling vehicle operation and indicating an external leak if fuel rail pressure drops below a threshold value during or after the activation of the lower pressure pump; and code for adjusting operation of one of the pumps during the subsequent engine start and indicating an internal leak if fuel rail pressure achieves at least the threshold value during or after the activation of the lower pressure pump.

20. The article of claim 19 further comprising code for setting a diagnostic code readable by a universal code reader, the setting responsive to each of the indication of a fuel leak, the indication of an internal leak, and the indication of the external leak.

* * * * *